US006240705B1

(12) United States Patent
Simmons, Jr. et al.

(10) Patent No.: US 6,240,705 B1
(45) Date of Patent: Jun. 5, 2001

(54) CUSHIONING CONVERSION SYSTEM

(75) Inventors: James A. Simmons, Jr., Painesville Township, OH (US); Herman R. L. Van Heumen, Heerlen (NL); Pierre H. G. Kobben, Kerkrade (NL); Andre Gunneweg, Brunssum (NL)

(73) Assignee: Ranpak Corp., Concord Township ( * ) Notice: Subject to any disclaimer, the term of this patent is extended or adjusted under 35 U.S.C. 154(b) by 0 days.

(21) Appl. No.: 09/236,973

(22) Filed: Jan. 26, 1999

Related U.S. Application Data

(63) Continuation of application No. PCT/US97/13172, filed on Jul. 28, 1997, which is a continuation-in-part of application No. 60/041,830, filed on Apr. 10, 1997, and a continuation-in-part of application No. 08/796,177, filed on Feb. 7, 1997, and a continuation-in-part of application No. 60/022,653, filed on Jul. 26, 1996.

(51) Int. Cl.[7] ..... B65B 1/04

(52) U.S. Cl. ..... 53/237; 53/235; 53/238; 493/464; 493/967

(58) Field of Search ..... 493/464, 967; 53/235, 237, 238, 390, 472, 495, 496

(56) References Cited

U.S. PATENT DOCUMENTS

| | | | |
|---|---|---|---|
| 3,251,452 | 5/1966 | Conway et al. . | |
| 3,621,981 | 11/1971 | Nimmo . | |
| 3,643,719 | 2/1972 | Kimberling . | |
| 3,820,648 | 6/1974 | Halvorsen . | |
| 3,865,058 * | 2/1975 | Rovin et al. | 493/438 |
| 3,899,166 | 8/1975 | Behn . | |
| 4,008,796 | 2/1977 | Aylon . | |
| 4,056,919 | 11/1977 | Hirsch . | |
| 4,073,375 | 2/1978 | Hart . | |
| 4,085,662 | 4/1978 | Ottaviano . | |
| 4,385,537 | 5/1983 | Wolf . | |
| 4,520,614 | 6/1985 | Aykut et al. . | |
| 4,619,635 | 10/1986 | Ottaviano . | |
| 4,746,255 | 5/1988 | Roccabianca et al. . | |
| 4,809,482 | 3/1989 | Horton et al. . | |
| 4,864,801 | 9/1989 | Fallas . | |
| 4,968,291 | 11/1990 | Baldacci et al. . | |
| 5,123,889 | 6/1992 | Armington et al. . | |
| 5,209,046 | 5/1993 | Tapscott et al. . | |
| 5,403,259 | 4/1995 | Parker . | |
| 5,637,071 | 6/1997 | Simmons et al. . | |

FOREIGN PATENT DOCUMENTS

| | | |
|---|---|---|
| 195 12 716 | 1/1996 | (DE) . |
| WO94/14548 | 7/1994 | (WO) . |
| WO95/13914 | 5/1995 | (WO) . |
| WO96/03273 | 2/1996 | (WO) . |
| WO96/03274 | 2/1996 | (WO) . |
| WO97/01434 | 1/1997 | (WO) . |

* cited by examiner

*Primary Examiner*—Stephen F. Gerrity
*Assistant Examiner*—Sam Tawfik
(74) *Attorney, Agent, or Firm*—Renner, Otto, Boisselle & Sklar, LLP

(57) ABSTRACT

A cushioning conversion system comprising a cushioning conversion machine, a packaging surface, and a dispenser. The cushioning conversion machine includes a conversion assembly which converts a sheet-like stock material into cushioning pads. The dispenser includes a receptacle in which the pads are placed in a vertical stack as they are produced by the cushioning conversion machine. The receptacle is positioned above the packaging surface when the pads are selectively withdrawn therefrom to package items on the packaging surface. The cushioning conversion system allows the accumulation of a plurality of cushioning pads for selective withdrawal without the packaging person having to bend over, without sacrificing valuable packaging surface space, and/or without substantially increasing the system's footprint.

40 Claims, 4 Drawing Sheets

CUSHIONING CONVERSION SYSTEM

RELATED APPLICATION DATA

This application is a continuation of PCT/US97/13172 filed Jul. 28, 1997, which is a continuation-in-part of U.S. Provisional Patent Application No. 60/022,653, filed Jul. 26, 1996, U.S. patent application Ser. No. 08/796,177, filed Feb. 7, 1997, and U.S. Provisional Patent Application No. 60/041,830, filed Apr. 10, 1997. The aforesaid applications are hereby incorporated herein by reference in their entireties.

FIELD OF THE INVENTION

The present invention relates to a cushioning conversion system which allows convenient and easy selective withdrawal of accumulated cushioning pads without sacrificing valuable packaging surface space and/or without substantially increasing the system's footprint.

BACKGROUND OF THE INVENTION

In the process of shipping an item from one location to another, a protective packaging material is typically placed in the shipping case, or box to fill any voids and/or to cushion the item during the shipping process. Some conventional commonly used protective packaging materials are plastic foam peanuts and plastic bubble pack. While these conventional plastic materials seem to adequately perform as cushioning products, they are not without disadvantages. Perhaps the most serious drawback of plastic bubble wrap and/or plastic foam peanuts is their effect on our environment. Quite simply, these plastic packaging materials are not biodegradable and thus they cannot avoid further multiplying our planet's already critical waste disposal problems. The non-biodegradability of these packaging materials has become increasingly important in light of many industries adopting more progressive policies in terms of environmental responsibility.

These and other disadvantages of conventional plastic packaging materials has made paper protective packaging material a very popular alternative. Paper is biodegradable, recyclable and renewable; making it an environmentally responsible choice for conscientious industries. While paper in sheet form could possibly be used as a protective packaging material, it is usually preferable to convert the sheets of paper into a relatively low density pad-like cushioning dunnage product. This conversion may be accomplished by a cushioning conversion machine, such as that disclosed in U.S. Pat. No. 5,123,899. This patent is assigned to the assignee of the present application and discloses a cushioning conversion machine which converts sheet-like stock material, such as paper in multi-ply form, into low density cushioning products or pads. The entire disclosure of this patent is hereby incorporated by reference.

A cushioning conversion machine (including the machine disclosed in U.S. Pat. No. 5,123,899) will usually comprise a conversion assembly (including a forming assembly, a feeding assembly, and a cutting assembly) and a stock supply assembly. During operation of the cushioning conversion machine, the stock supply assembly supplies the stock material to the forming assembly. The forming assembly causes inward rolling of the lateral edges of the sheet-like stock material to form a continuous strip having lateral pillow-like portions. The feeding assembly pulls the stock material through the machine and also connects (or coins) the central band of the continuous strip to form a connected strip. The connected strip travels downstream to the cutting assembly which cuts the coined strip into products or pads of a desired length. The machine may also include a post-cutting assembly, through which the cut pads travel.

In the above-referenced patent, the stock supply assembly includes two U-shaped brackets each having lower legs with slots. A rod is extended through the stock roll and the ends of the rod are supported within these slots of the stock supply assembly. Alternatively, the rod is supported within similar rod supporting slots on a separate stock cart. In either case, the stock roll freely rotates about the rod as the stock material is pulled through the forming assembly by the feeding assembly. As an alternative to such free rotation of the stock roll, this and other cushioning conversion machines may incorporate a powered infeeding assembly which feeds the stock material at a controlled tension to the stock supply assembly.

The transfer of the cushioning product or pad away from the machine's outlet may be accomplished by gravity and/or by the approaching coined strip urging the cut pad away from the machine. Alternatively, a pad-transferring assembly may be incorporated into a cushioning conversion machine which provides a positive, mechanical means (such as a powered conveying unit) for transferring cut pads away from the machine. A pad-transferring assembly is disclosed in U.S. patent application Ser. No. 08/796,177, filed on Feb. 7, 1997, entitled AUTOMATED CUSHIONING PRODUCING AND FILLING SYSTEM, the entire disclosure of which is hereby incorporated by reference.

The control of the machine's conversion assemblies (more specifically the activation/deactivation of its feeding assembly and/or of its cutting assembly), or the mode of operation of the machine, may be manual or automatic. A cushioning conversion machine may be manufactured to operate in one particular mode of operation. Alternatively, a machine controller may be incorporated into a cushioning conversion machine which allow operation in a selected one of a plurality of modes of operation. A suitable machine controller is disclosed in International Patent Application No. PCT/US95/09275 to Ranpak Corp. (the assignee of the present application) filed on Jul. 21, 1995 published as No 96/03274 and entitled CUSHIONING CONVERSION MACHINE. The entire disclosure of this international application is hereby incorporated by reference.

In the automatic mode of operations, the feeding assembly and/or the cutting assembly are automatically activated/deactivated to produce pads of the desired length. For example, in certain automatic modes of operation, upon receipt of an appropriate "start" signal, the feeding assembly is activated for a period of time required to produce the desired length of dunnage strip, the feeding assembly is then deactivated and the cutting assembly activated to cut the dunnage strip to produce the desired cushioning pad. In one automatic mode of operation, the feeding assembly is then automatically re-activated for the same period of time and the cycle is repeated until an appropriate "stop" signal is received whereby a multitude of pads of the same length will be produced for each "start" signal. (The "stop" signal may be generated by the pushing of a "stop" button on the machine or may be automatically generated by an appropriately placed sensor or a counter.) In another automatic mode of operation, the feeding assembly remains deactivated until receipt of another "start" signal and thus one pad is produced for each "start" signal.

In the above-described cushioning conversion machine (and, in fact, in most cushioning conversion machines) the cushioning pads are discharged to a transitional zone, and then, at the appropriate time, inserted into a container for cushioning purposes. For example, temporary receptacles (i.e., bins) have been placed adjacent to the machine's outlet so that the cushioning pads can be discharged therein to form a pile. At the appropriate time, the packaging person would bend over to reach into the transitional receptacle, retrieve a cushioning pad from the accumulated pile, return to his/her workstation and then insert the cushioning pad in the container.

Additionally, tables having horizontal work platforms have been employed as transitional zones. Specifically, the table is positioned relative to the cushioning conversion machine so that the cushioning pads are deposited on the horizontal work platform. When a packaging need arises, the packaging person picks up the cushioning pad from the work platform and then, if the platform also functions as a packaging surface, immediately inserts the cushioning pad in the container.

Further, horizontal conveyor belts have been used as transitional zones for cushioning conversion machines. Specifically, the cushioning conversion machine is positioned to deposit the cushioning pads on the conveyor belt which then moves the pad in a certain conveying direction. Packaging personnel (perhaps at a remote location on the conveyor belt) then pick up a cushioning pad from those accumulated on the conveyor belt and insert the cushioning pad in the containers being packaged.

Still further, slides have been used as transitional zones for cushioning conversion machines. Specifically, a slide is positioned so that its upper end is adjacent the machine's outlet whereby the discharged cushioning pads are deposited thereon and then travel down the length of the slide. In certain slides, the cushioning pads are stacked end-to-end; in other slides, the cushioning pads are stacked side-to-side. In either case, the bottom pad would be removed and used for cushioning purposes.

These and other transitional zones have all performed quite successfully in a variety of cushioning conversion systems and they are expected to continue to do so in the future. However, a temporary receptacle (Le., a bin) requires a packaging person to bend over to retrieve a cushioning pad. While a transitional horizontal surface in the form of a table may eliminate the need to bend over, the pads will be accumulated in a pile and may even fall from the table's surface if too many pads are produced. Moreover, the accumulation of the pads on the table decreases valuable packaging work space. Regarding the accumulation of pads on a conveyor belt, this substantially increases a system's footprint since the pads are necessarily arranged end-to-end in a horizontal manner. Regarding slides, their sloped nature may make it difficult for them to double as a packaging surface thereby requiring a separate (and space consuming) packaging surface which substantially increases the system's footprint.

SUMMARY OF THE INVENTION

The present invention addresses the problem of the absence in the industry of a cushioning conversion system which allows the accumulation of a plurality of cushioning pads, which allows the convenient and selective withdrawal of cushioning pads without sacrificing valuable packaging space and/or without substantially increasing the system's footprint.

The problem addressed by the invention is solved by providing a cushioning conversion system comprising a cushioning conversion machine, a packaging surface and a dispenser. The cushioning conversion machine includes a conversion assembly which converts a sheet-like material into cushioning pads. The dispenser includes a receptacle in which the pads are placed in a vertical stack as they are produced by the cushioning conversion machine. The receptacle is positioned above the packaging surface when the pads are selectively withdrawn therefrom to package items on the packaging surface. Thus, a cushioning conversion system according to the present invention allows the accumulation of a plurality of cushioning pads which may be selectively withdrawn without the packaging person having to bend over, without sacrificing valuable packaging surface space and/or without substantially increasing the system's footprint.

The receptacle includes a set of walls forming a rectangular structure and the pads are withdrawn from a non-top side of the receptacle. In certain preferred embodiments, the receptacle includes an opening for withdrawing a pad from the dispenser which is sized so that the pads will be withdrawn one-by-one from the dispenser and which is positioned so that only the bottom-most pad will be withdrawn from the dispenser. The set of walls may include two side walls with each including a pad-withdrawal opening whereby the system may accommodate two packaging people. Alternatively, the set of walls may include a downstream wall on which the pad-withdrawal opening is located. In another preferred embodiment of the invention, the receptacle includes only one side wall whereby one side of the receptacle is open for withdrawal of pads therefrom.

The pads may be directly deposited into the receptacle, either by dropping the pads directly into the receptacle from the outlet of the cushioning conversion machine or by transferring the pads with a pad-transferring assembly to the receptacle. Alternatively, the cushioning conversion system may include a loader which loads pads produced by the cushioning conversion machine into the receptacle. In the latter case, the system may further comprise a loading stage on which the pad is temporarily placed for subsequent lifting and loading by the loader.

The packaging surface may comprise, for example, a table having a horizontal work platform or a conveyor having a moving horizontal belt. The packaging surface may be located adjacent the cushioning conversion machine and the receptacle located directly above the packaging surface. In this arrangement, the dispenser may include a support on which the receptacle is mounted or the receptacle may be mounted to the cushioning conversion machine. The packaging surface may alternatively be located at a packaging site remote from the cushioning conversion machine. In the latter case, the dispenser would preferably be adapted to be transported from the loading site to the packaging site for withdrawal of pads from the receptacle for packaging purposes and transported back to the loading site for loading of pads into the receptacle.

The pads may be vertically stacked in a semi-random fashion in the receptacle. (In other words, the pads are vertically stacked on top of each other in the receptacle but not in a row. This is a different arrangement than the horizontal end-to-end fashion and/or the horizontal/sloped side-to-side fashion discussed above in connection with conveyors or slides.) Alternatively, the pads may be vertically stacked in row fashion in the receptacle, either in one row or a plurality of rows. If the pads are stacked in a plurality of rows, the receptacle may include a compartment for each row.

To fill the receptacle, the cushioning conversion machine may be activated to convert the stock material into cushioning pads and then deactivated upon an operator's visual verification that the receptacle is full. Alternatively, the dispenser may include a sensor which senses when the receptacle is full and the cushioning conversion machine may automatically repeatedly produce pads unless the sensor senses that the dispenser is full. A further alternative is for the cushioning conversion machine to repeatedly produce pads until a predetermined number of pads have been placed in the receptacle.

These and other features of the invention are fully described and particularly pointed out in the claims. The following description and annexed drawings set forth in detail several illustrative embodiments, these embodiments being indicative of but a few of the various ways in which the principles of the invention may be employed.

DETAILED DESCRIPTION

Figure 1:
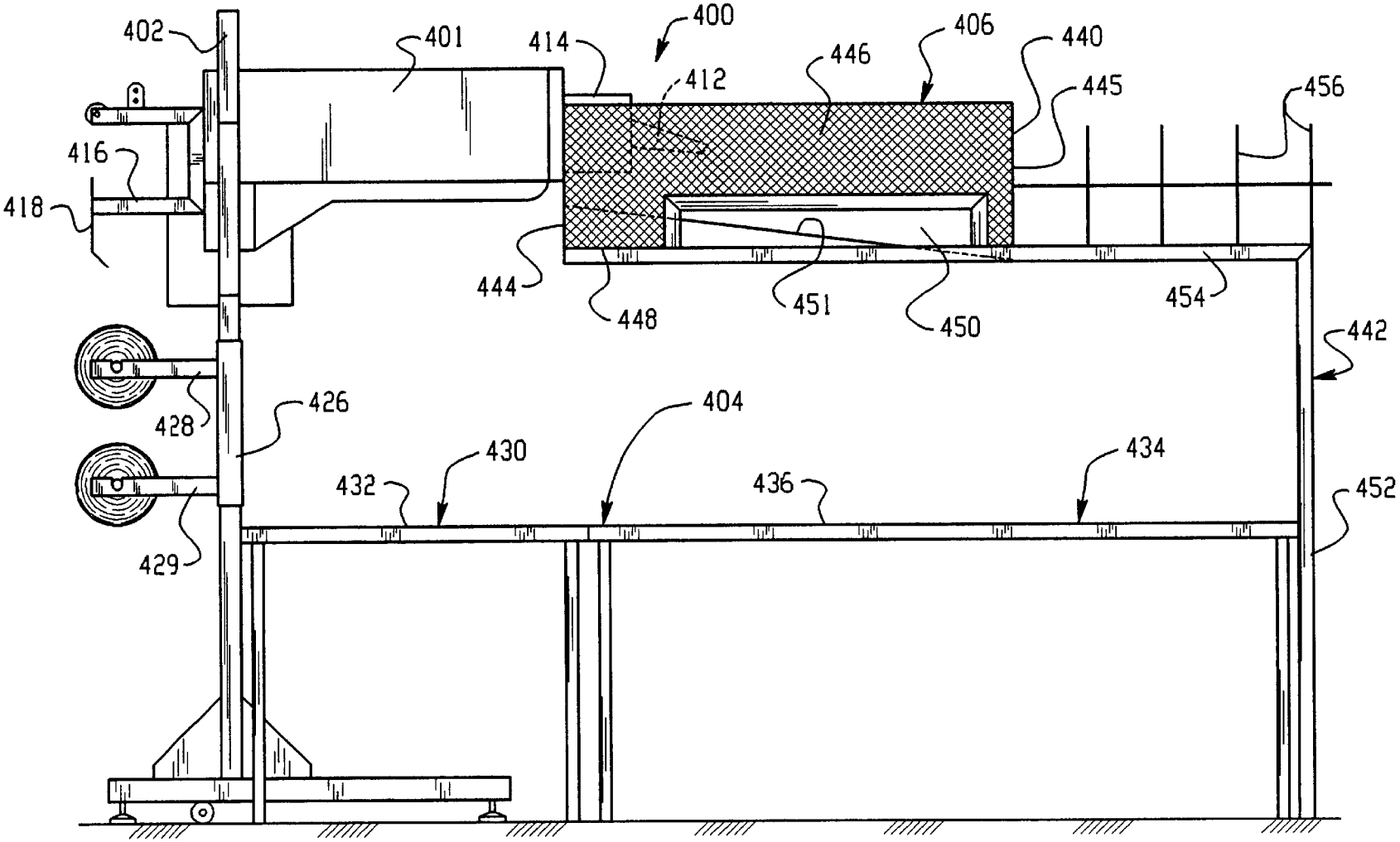
FIG. 1 is a side view of a cushioning conversion system 400 according to the present invention.

A cushioning conversion system 400 according to the present invention is shown in FIG. 1. The system 400 includes a cushioning conversion machine 401, a machine stand 402, a packaging surface 404, and a dispenser 406. The machine stand 402 supports and positions the cushioning conversion machine 401 so that the cushioning pads produced thereby will be deposited, and thus loaded, in the dispenser 406. The dispenser 406 is arranged and positioned so that the cushioning pads may be withdrawn therefrom and conveniently used to package items on the packaging surface 404.

The cushioning conversion machine 401 may be substantially the same as the cushioning conversion machine disclosed in U.S. Pat. No. 5,123,899 in a horizontal orientation. However, the system 400 may incorporate any cushioning conversion machine in any orientation, which falls within the scope of the claims. In the illustrated system 400, the cushioning conversion machine 401 includes a deflector 412 attached to the outlet of its post-cutting assembly 414 to urge the cut pads in the appropriate direction. The machine 401 may also include a modified stock supply assembly in which the stock roll is not supported in the lower leg 416 of the U-shaped brackets (and thus the lower legs 416 need not include open slots). Instead, the stock supply assembly includes a guide plate 418 attached to the distal ends of its lower legs 416.

The machine stand 402 includes a floor support, two vertical posts extending upwardly from the floor support, and a machine shelf extending in a cantilever fashion from support portions of the vertical posts. The machine 401 rests on the shelf with its upstream end positioned between the vertical posts and its other portions extending outwardly over at least a portion of the packaging surface 404. The floor support preferably includes wheels for easy movement of the stand 402 to the desired location and leveling feet for parking at this location. Preferably, the machine shelf is attached to the vertical posts via sliders whereby the vertical height of the machine may be selectively adjusted to accommodate different packaging situations. In any event, the machine 401 is positioned in an elevated position relative to the packaging surface 404. Preferably, the machine 401 is operated in a mode of operation wherein its feeding assembly and its cutting assembly are automatically repeatedly activated to produce a multitude of pads of the same length until an appropriate "stop" signal is received.

The machine stand 402 may also incorporate components of the machine's modified stock supply assembly. Specifically, a dual stock roll support 426 may be mounted to the stand's vertical posts. The support 426 includes an upper pair of legs 428 and a lower pair of legs 429. The legs 428 and 429 each have open slots in their distal ends to cradle a supply rod. In use, the stock material supplied from the stock roll supported by the upper pair of legs 428 is guided by the guide plate 418 to the machine's stock supply assembly for conversion into a cushioning pad. Upon depletion of this stock roll, the stock roll supported by the lower pair of legs 429 would be guided by the guide plate 418 to the machine's stock supply assembly for conversion into a cushioning pad, without having to reload the upper pair of legs with a fresh stock roll. When both stock rolls are depleted, the legs 428 and 429 could be re-loaded with fresh stock rolls at the same time. Although not shown in the drawings, this type of stock supply assembly is especially compatible with a splicing system (in which the trailing ends of the stock roll being used are attached to the leading ends of a new stock roll).

In the preferred embodiment, the packaging surface 404 is formed by a first table 430 having a horizontal work platform 432 and a second table 434 having a work platform 436. Specifically, the work platforms 432 and 436 are positioned flush with each other to form a continuous surface. The first table 430 is positioned adjacent the vertical posts of the stand 402 and its work platform 432 is positioned over the downstream portion of the machine floor support and under the cushioning conversion machine 401 with its major axis being transverse to the upstream-downstream direction. The second table 434 is of a lesser width than the first table 430 and its major axis extends downstream from the downstream edge of a central portion of the first table 430. In this manner, the tables 430 and 434 form a generally T-shape packaging surface.

The dispenser 406 includes a receptacle 440 and a dispenser stand 442 for positioning the receptacle 440 in the desired position relative to the machine 401 and/or packaging surface 404. The receptacle 440 includes a set of walls forming a rectangular structure. In the preferred receptacle 440, these walls include an upstream wall 444, a downstream wall 445, side walls 446, and a bottom wall 448. The receptacle 440 is sized to accommodate a plurality of pads such as, in the illustrated embodiment, approximately fifteen to twenty pads.

The upstream wall 444 includes a cut-out for accommodating the outlet of the cushioning conversion machine 401, namely its deflector 412 and its post-cutting assembly 414. The side walls 446 each include an opening 450 so that cushioning pads may be selectively withdrawn from either side of the receptacle 440. The opening 450 is preferably, but not necessarily, sized and arranged so that the bottom-most pads will be withdrawn one-by-one from the receptacle 440. The bottom wall 448 includes a downwardly (in the downstream direction) sloping surface or slide 451. The slide 451 may also slope downwardly towards the side openings 450.

The dispenser stand 442 includes a vertical supporting member 452 and a horizontal member 454 extending from an upper end thereof. In the illustrated dispenser stand 442, the vertical supporting member 452 is attached to the downstream end of the second table 434 and/or the floor, and the horizontal member 454 (or shelf) extends over the table's work platform 436 towards the machine 401. The receptacle 440 rests on the distal portion of the shelf 454 and the outlet of the cushioning conversion machine 401 is positioned within the cut-out in the receptacle's upstream wall 444. The dispenser stand 442 may also include divider elements 456 for storing not-yet-folded carton boxes and other packaging supplies.

In operation of the cushioning conversion system 400, the stock material is converted into a cushioning pad by the cushioning conversion machine 401 and the pad is ejected through the machine's outlet or post-cutting assembly 414. The deflector 412 directs the cushioning pad into the receptacle 440. Once the cushioning pad is deposited or dropped into the receptacle 440, it slides down the bottom sloped surface 451 and is positioned adjacent the downstream end of the openings 450 in the side walls 446. In the illustrated embodiment, the cushioning conversion machine 401 repeatedly converts the stock material into cushioning pads and until its conversion assembly is deactivated upon a packaging person's visual verification that the receptacle is full and the packaging person sends a "stop" signal to the machine by pressing a stop button. However, alternatively, the dispenser 406 may include a sensor which senses when the receptacle is full and the cushioning conversion machine may automatically repeatedly produce pads unless the sensor senses that the dispenser is full. (Such a "sensing" method is described below in connection with the cushioning conversion system 500.) A further alternative is for the cushioning conversion machine to repeatedly produce pads until a predetermined number of pads have been placed in the receptacle. (Such a "counting" method is described below in connection with the cushioning conversion system 600.)

As the cushioning pads are produced and ejected, they accumulate in the receptacle 440. The pads may be vertically stacked in a neat row in the receptacle 440. However, in the illustrated embodiment, the pads are vertically stacked in a semi-random fashion in the receptacle 440. (In other words, although not neatly stacked in a vertical row, they are not arranged horizontally end-to-end and/or they are not arranged side-to-side.) In either event, a packaging person selectively withdraws cushioning pads from the receptacle 440 to package boxes or cartons on the packaging surface 404. Also, because of the T-shape geometry of the packaging surface 404 and/or the openings 450 on both of the receptacle's side walls 446, the cushioning conversion system 400 may efficiently accommodate two packaging people, with one standing, for example, on either side of the second table 434.

Thus, the cushioning conversion system 400 allows the accumulation of a plurality of cushioning pads for selective withdrawal without the packaging person having to bend over, without sacrificing packaging surface space, and/or without substantially increasing the system's footprint.

Figure 2:
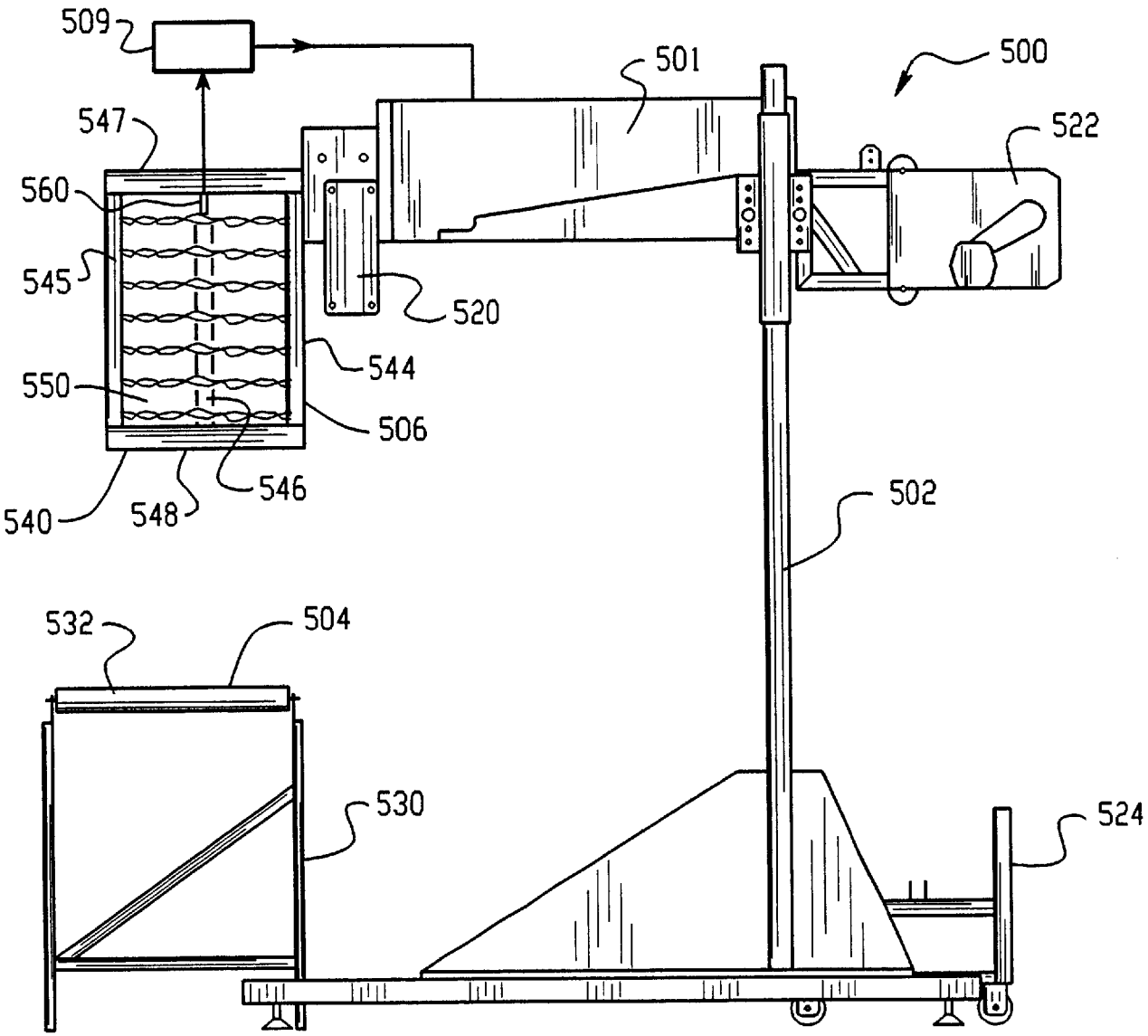
FIG. 2 is a side view of another cushioning conversion system 500 according to the present invention.

Another cushioning conversion system 500 according to the present invention is shown in FIG. 2. The system 500 comprises a cushioning conversion machine 501, a machine stand 502, a packaging surface 504, a dispenser 506, and a system controller 509. The machine stand 502 supports and positions the cushioning conversion machine 501. The dispenser 506 is attached to the machine 501 and is positioned so that the cushioning pads may be withdrawn therefrom and conveniently used to package items on the packaging surface 504.

The cushioning conversion machine 501 may be similar or the same as the one disclosed in U.S. Pat. No. 5,123,899 in a horizontal orientation. However, the system 500 may incorporate any cushioning conversion machine, in any orientation, which falls within the scope of the relevant claims. The illustrated cushioning conversion machine 501 includes a pad-transferring assembly 520 and a modified stock supply assembly including a powered infeed assembly 522 and a stock dispensing cart 524. Preferably, the machine 501 is operated in a mode of operation wherein its feeding assembly and its cutting assembly are automatically repeatedly activated/deactivated to produce a multitude of pads of the same length until an appropriate "stop" signal is received.

The machine stand 502 is similar to the machine stand 402. The machine 501 rests on the stand's shelf with its upstream end positioned between the vertical posts and its other portions extending outwardly to the edge of the packaging surface 504. In the preferred embodiment, the packaging surface 504 is formed by a conveyor 530 having a moving horizontal surface 532 (i.e. a belt and/or rollers). The machine 501 and the dispenser 506 are positioned in an elevated position relative to the packaging surface 504.

The dispenser 506 includes a receptacle 540 which is attached to the machine 501 and is positioned directly downstream of the pad-transferring assembly 520. (Thus, unlike the dispenser 406 of system 400, the dispenser 506 does not include a dispenser stand.) The receptacle 540 includes a set of walls forming a rectangular structure. In the preferred receptacle 540, these walls include an upstream wall 544, a downstream wall 545, side walls 546, a top wall 547 and a bottom wall 548. The walls define a space sized to accommodate a predetermined number of pads of a certain length which are vertically stacked in a single row.

The upstream wall 544 of the receptacle 540 includes an upper opening through which the pads are positively transferred by the pad-transferring assembly 520 into the receptacle 540. The downstream wall 545 includes a pad withdrawal opening 550 which is preferably sized and positioned so that only the bottom-most pad may be withdrawn from the receptacle 540. The upstream wall 544 and the downstream wall 545 are preferably formed from plate-like members having the above-described openings. The side walls 546 are formed from three vertical bar-like members. The top wall 547 and the bottom wall 548 may be formed from plate-like members or bar-like members.

The dispenser 506 further includes a dispenser sensor 560 which senses whether the dispenser is "full" or "not full" and generates a corresponding signal. In the preferred embodiment, the sensor 560 is of a photoelectric nature with its coordinating components (i.e., a transmitter/receiver and reflector, or a transmitter and a separate receiver), positioned on respective side walls 546 at a height corresponding to a "full" receptacle 540. If the transmitted light beam is blocked for a sufficient period of time (i.e. a period of time greater than that required for a cushioning pad to pass by the sensor 560 as it travels downward in the receptacle 540), the sensor 560 generates a "full" signal. If the transmitted light beam is not blocked, the sensor 560 generates a "not full" signal.

The system controller 509 includes means for receiving the "full" and "not full" signal from the dispenser sensor 560. The system controller 509 also includes means for sending "start" and "stop" signals to the cushioning conversion machine 501 based upon the signals received from the dispenser sensor 560.

In operation of the system 500, the machine 501 is initially idle and, if the dispenser 506 is not fully stocked with pads, the sensor 560 generates a "not full" signal. The system controller 509 sends a "start" signal to the cushioning conversion machine 501 whereby its feeding assembly is activated to produce a dunnage strip of a certain length, the feeding assembly is then deactivated and the cutting assembly is activated to cut the strip to produce the cushioning pad. This cycle is automatically repeated and the sequentially produced pads are positively transferred to the dispenser 506 by the pad-transferring assembly 520 to fill the receptacle 540.

The cushioning pads are vertically stacked one on top of each other in the receptacle 540 in a single neat row. In the illustrated embodiment, the neatness of the row is accomplished by the positioning/design of the pad-transferring assembly 520 and/or the geometry of the receptacle 540. However, it may be necessary in certain systems for the dispenser 506 to include means to encourage the row arrangement. For example, air jets could be turned on to support the pad relatively horizontally as it crosses through the receptacle 540. The air jets would be turned off once the pad reaches the downstream wall 545 so that the pad would drop neatly onto the stack or other air jets could be used to direct the pad downward.

Once a certain number of pads has been stacked in the receptacle 540, and the receptacle 540 is restocked or full, the dispenser sensor 560 will generate a "full" signal. Upon the system controller 509 receiving the "full" signal, it sends a "stop" signal to the cushioning conversion machine 501 to stop the automatic feeding/cutting cycle.

The packaging person withdraws the bottom-most pad from the dispenser 506 for use in packaging an article within a box or container on the packaging surface 504. Upon withdrawal of the bottom-most pad from the dispenser 506, the dispenser sensor 560 generates a "not full" signal and, upon receipt of this signal, the system controller 509 sends a "start" signal to the cushioning conversion machine 501 to resume the automatic and repeated activation/deactivation of its feeding assembly and its cutting assembly. In this manner, the dispenser 506 remains fully stocked with cushioning pads whereby there is no delay in the packaging process due to a lag in the production of cushioning pads.

Thus, the cushioning conversion system 500 allows the accumulation of a plurality of cushioning pads for selective withdrawal without the packaging person having to bend over, without sacrificing packaging surface space, and/or without substantially increasing the system's footprint.

Figure 3:
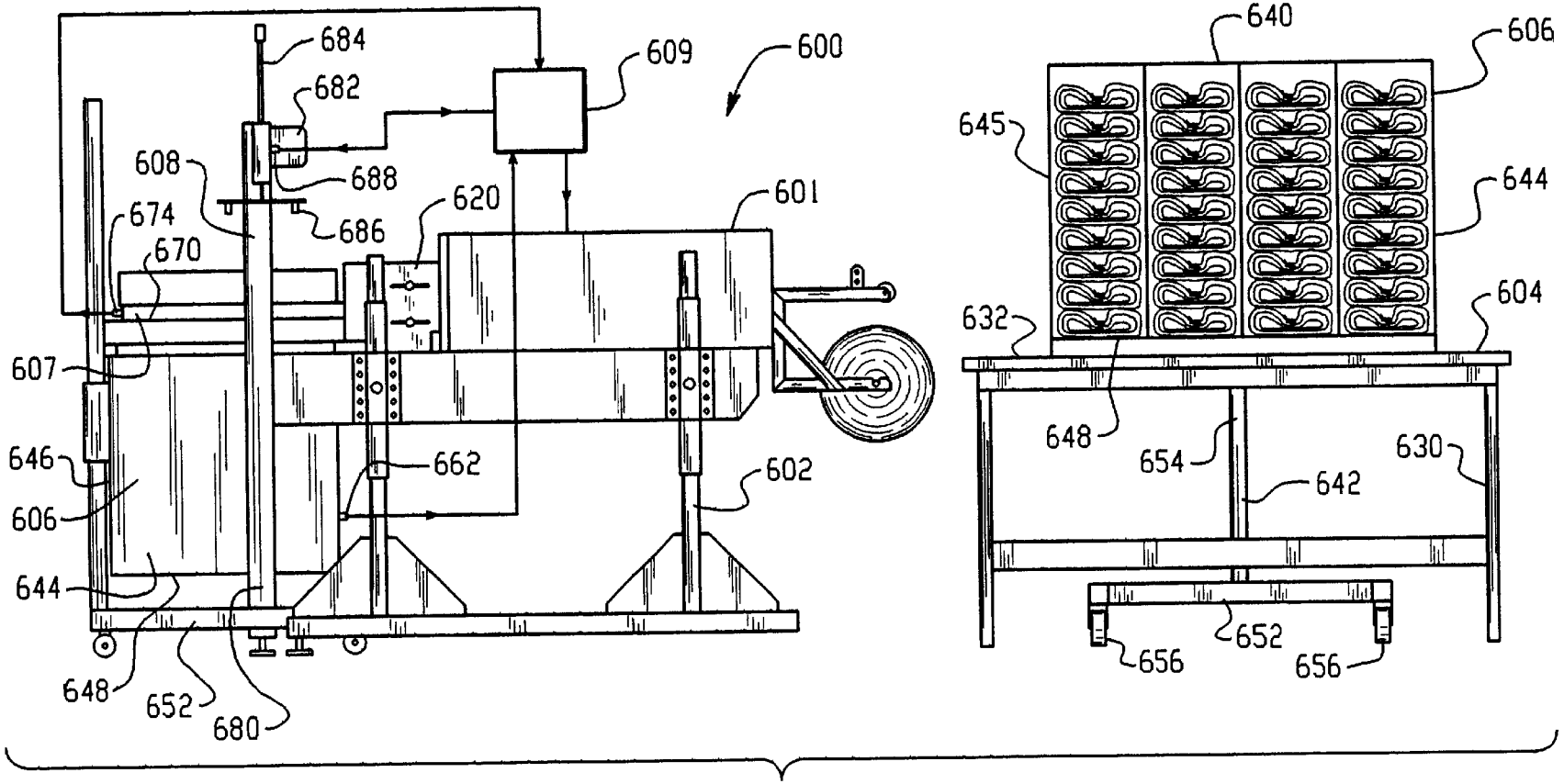
FIG. 3 is a side view of another cushioning conversion system 600 according to the present invention.
Figure 4:
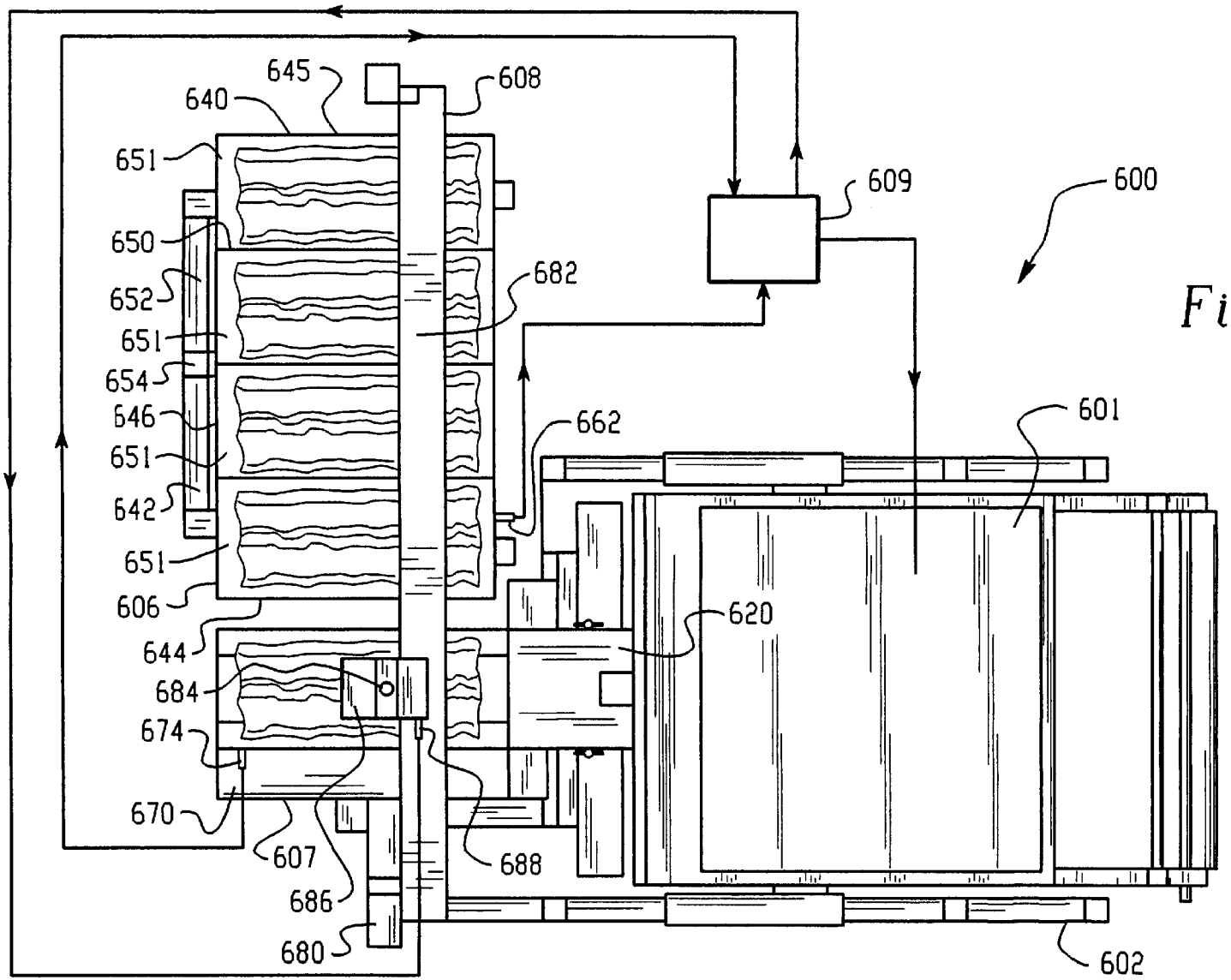
FIG. 4 is a top view of the loading site of the cushioning conversion system 600.

Another cushioning conversion system 600 according to the present invention is shown in FIGS. 3 and 4. The dispensing system 600 includes a cushioning conversion machine 601, a machine stand 602, a remote packaging surface 604, a dispenser 606, a loading stage 607, a loader 608 and a system controller 609. The machine stand 602 supports and positions the cushioning conversion machine 601 so that a cushioning pad produced thereby will be deposited on the stage 607. The loader 608 moves the cushioning pad from the stage 607 and loads it into the dispenser 606. Once the dispenser is filled with pads, the dispenser 606 is transported to the remote packaging surface 604 so that cushioning pads may be withdrawn therefrom and conveniently used to package items on the packaging surface 604.

The cushioning conversion machine 601 may be similar or the same as the one disclosed in U.S. Pat. No. 5,123,899 in a horizontal orientation. However, the system 600 may incorporate any cushioning conversion machine, in any orientation, which falls within the scope of the claims. The cushioning conversion machine 601 additionally includes a pad-transferring assembly 620. The machine 601 is preferably operated in an automatic mode of operation wherein, upon receipt of a "start" signal, the feeding assembly is activated to produce a dunnage strip of a predetermined length, the feeding assembly is then deactivated and the cutting assembly is activated to cut the strip to produce the cushioning pad. The feeding assembly remains deactivated until receipt of another "start" signal. The predetermined length of the pad corresponds to the analogous dimension of the dispenser 606, as is explained in more detail below.

The machine stand 602 includes a floor support, two pairs of vertical posts extending upwardly from the floor support, and a shelf extending between the pairs of vertical posts. The machine 601 rests on the shelf and is positioned in an elevated position. The preferred packaging surface 604 is formed by a first table 630 having a horizontal work platform 632. Unlike the systems 400 and 500, in the system 600 the packaging surface 604 is positioned remote from the cushioning conversion machine 601.

The dispenser 606 includes a receptacle 640 and a dispenser stand 642 for positioning the receptacle 640 in the desired position relative to the machine 601 and/or the packaging surface 604. The receptacle 640 includes a set of walls defining a rectangular structure. In the illustrated receptacle 640, these walls include an upstream wall 644 (i.e., the wall closest to the stage 607), a downstream wall 645, one side wall 646, and a bottom wall 648. The receptacle 640 further includes a series of vertical dividers 650 forming a series of linearly adjacent pad compartments 651. In the illustrated embodiment, the receptacle 640 includes four compartments 651. Since the receptacle 640 includes only one side wall, each pad compartment 651 is enclosed on three vertical sides with one side open for removal of pads. Also, since the receptacle 640 does not include a top wall, the top of each compartment 651 is open to permit the pads to be placed therein in a vertical stacked arrangement by the loader 608. Alternatively, the receptacle 640 could include another side wall and one or both of the side walls could have a pad-withdrawal opening or one pad-withdrawal opening for each compartment 651. The pad withdrawal openings would preferably be sized and positioned to allow only the bottom-most pad to be withdrawn from each compartment.

Each of the compartments 651 is sized to accommodate a predetermined number of pads each having a predetermined length in a vertical stack. The predetermined length of the pads corresponds to the width of the upstream wall 644, the downstream wall 645 and the bottom wall 648. The predetermined number of pads needed to fill each compartment 651 corresponds to height of the upstream wall 644, the downstream wall 645, and the side wall 646. In the illustrated embodiment, twelve pads are required to fill each compartment 651. Accordingly, when the dispenser 606 is fully loaded, the receptacle 640 will contain forty-eight pads.

The dispenser stand 642 includes a horizontal floor support 652 and a vertical post 654 extending upward therefrom. The floor support 652 preferably includes rollers or castors 656 to allow the dispenser 606 to be easily rolled from the cushioning conversion machine 601 to the remote packaging surface 604. The receptacle 640 is preferably mounted to the vertical post 654 in a height-adjustable manner so that the height of the receptacle 640 may, for example, be set at a height above the packaging surface 604 for unloading pads from the compartments 651 and at a lower height for loading the pads in the compartments 651. Additionally or alternatively, the receptacle 640 is preferably spring mounted to the vertical post 654 so that it can be biased downward to a compressed state and temporary locked to load the dispenser 606 and then unlocked from this compressed state to expand upward for withdrawal of the pads at the packaging surface 604.

The dispenser 606 further includes a sensor 662 which senses whether the dispenser 606 is positioned to load and generates a corresponding signal. Since the dispenser 606 is intended to be transported from the loading location (i.e. adjacent to the machine 601) to the remote packaging surface 604, the receiving component of the sensor 662 would preferably be located on a non-moving part of the system 600. For example, a transmitter/receiver could be mounted on the cushioning conversion machine 601 with a reflector mounted on the dispenser 606. In any event, this sensor 662 helps insure that the dispenser 606 is correctly positioned relative to the machine 601 for accurate loading of the pads therein.

The loading stage 607 is located directly downstream of the pad-transferring assembly 620 and includes a platform 670 which is preferably continuous with a conveying element (i.e., a moving belt) of the pad-transferring assembly 620. The stage 607 also includes a sensor 674 (i.e., an optical unit) which sense the presence or absence of a pad on the platform 670 and generates corresponding "pad present" and "pad absent" signals. The system 600 is designed so that the dispenser 606 is always loaded with pads of substantially the same length and the sensor 674 is positioned relative to the platform 670 in accordance with this set pad length. However, a moving stage platform (such as a conveyor) with a downstream dam could be employed in a modified system to ensure that the sensor 674 will sense pads of shorter lengths. Specifically, the conveyor would convey the pad downstream until it encounters the dam and the sensor would be positioned just upstream of the dam.

The loader 608 may be any device or devices which is capable of lifting the pads from the stage 607 and loading them into the appropriate compartment 651 of the receptacle 640. In the illustrated embodiment, the loader 608 comprises a frame post 680, a horizontally movable carrier 682 mounted to the post 680, a vertically movable lifter 684 mounted to one end of the carrier 682, and a hand 686 mounted to the lower end of the lifter 684. The horizontal movement of the carrier 682 and the vertical movement of the lifter 684 may be obtained by fluid powered double acting cylinders and preferably biased to a rest position. The hand 686 includes one or more vacuum ports which the system controller 609 may open to hold a pad and close to release a pad. The extending/retracting of the carrier 682 and the lifter 684, and the opening/closing of the hand's vacuum ports are controlled by the system controller 609.

The frame post 680 is positioned relative to the dispenser 606 and the stage 607 so that the carrier 682 and the lifter 684 may coordinate to move the hand 686 among a rest position (elevated above the stage 607), a pad-engaging position (substantially within or just above the stage 607), and pad-releasing positions (substantially within or just above the compartments 651 of the receptacle 640.) When the loader 608 is in a ready-to-load condition, the carrier 682 and the lifter 684 are positioned in the rest position and the vacuum ports of the hand 686 are closed. The loader 608 includes a sensor 688 which senses whether the loader is in a "ready-to-load" condition and generates a corresponding signal.

The system controller 609 includes means for receiving "pad present" and/or "pad absent" signals from the stage sensor 674 and for receiving "positioned-to-load" signals from the dispenser sensor 662. The system controller 609 also includes means for sending signals to the cushioning conversion machine 601 and the loader 608 based on the signals received from stage sensor 674 and/or the dispenser sensor 662. The signals sent to the machine 601 are used in the automatic control machine's conversion assembly (i.e. its feeding assembly and its cutting assembly). The signals sent to the loader 608 are used to automatically extend/retract the carrier 682 and the lifter 684 and to open/close the vacuum ports of the hand 686. The system controller 609 may also include means for receiving "ready-to-load" signals from the loader sensor 688.

In operation of the cushioning conversion system 600, the machine 601 is initially in an idle condition, the loading stage 607 is empty, and the loader 608 is in its ready-to-load condition. The empty dispenser 606 is placed in its loading position whereby the "positioned-to-load" signal is sent to the system controller 609. The system controller 609 then sends a "start" signal to the cushioning conversion machine 601 whereby its feeding assembly is activated/deactivated to produce a dunnage strip of the predetermined length and its cutting assembly is then activated to cut the strip to produce the cushioning pad. The pad-transferring assembly 620 transfers the cushioning pad to the stage 607 whereat sensor 674 sends a "pad present" signal to the system controller 609.

The system controller 609 then sends signals to the loader 608 to remove the pad from the stage 607 and load it into the first compartment 651 of the receptacle 640 to be filled. Specifically, the lifter 684 is lowered from the rest position to the pad-engaging position and the vacuum ports of the hand 686 are opened to hold the pad. The lifter 684 is re-elevated (with the hand 686 still holding the pad), the carrier 682 is moved horizontally to a position above the appropriate compartment 651 of the receptacle 640, and the lifter 684 is lowered to the pad-releasing position. The vacuum ports of the hand 686 are then closed whereby the pad is released into the appropriate compartment 651. The lifter 684 is then re-elevated and the carrier 682 horizontally returned back to the rest position.

The system controller 609 then sends another "start" signal to the cushioning conversion machine 601 and the cycle is repeated until the dispenser 606 is fully loaded. Preferably, the subsequent "start" signals are based upon the completion of some step of the loading process. For example, the subsequent "start" signals may be based on the "pad absent" signal received by the system controller 609 from the stage sensor 674 upon removal of the earlier-produced pad from the stage 607 by the loader 608. Alternatively, the subsequent "start" signals may be based on the "ready-to-load" signal received by the system controller 609 from the loader sensor 688 upon return of the loader 608 to the rest position after loading the earlier-produced pad in the dispenser 606. Another alternative is for the subsequent "start" signals to be automatically generated by the system controller 609 at predetermined time intervals corresponding to an estimated loading time.

Once the predetermined number of pads have been loaded into the first compartment 651 of the dispenser 606 (twelve in the illustrated embodiment), the cycle continues except that the controller 609 moves the carrier 682 to an appropriate position corresponding to the next compartment 651. Once the predetermined number of pads have been loaded into this next compartment, the next compartment is similarly loaded until all of the compartments 651 are full. The system controller 609 ceases sending any more "start" signals to the machine 601 until the loaded dispenser 606 has been removed and a later "positioned to load" signal is generated by the dispenser sensor 662 upon return of the same or another empty dispenser 606 for reloading.

When the dispenser 606 is fully loaded, it is removed from its loading position and moved to the remote packaging surface 604 where the packaging is to be done. (Thus, the dispenser 606 constitutes a transport vehicle.) In the illustrated embodiment, the receptacle 640 is positioned at one height for loading and then raised to higher height so that the receptacle 640 is positioned vertically above the packaging surface 604.

Thus, the cushioning conversion system 600 allows the accumulation of a plurality of cushioning pads for selective withdrawal without the packaging person having to bend over, without sacrificing packaging surface space, and/or without substantially increasing the system's footprint.

Although the invention has been shown and described with respect to a certain preferred embodiment, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A cushioning conversion system comprising a cushioning conversion machine, a packaging surface, and a dispenser;

the cushioning conversion machine including a conversion assembly which converts a sheet-like stock material into cushioning pads;

the dispenser including a receptacle in which the pads are placed in a vertical stack as they are produced by the cushioning conversion machine;

the receptacle having a side wall with an opening therein, the receptacle positioned above the packaging surface for selectively withdrawing the pads through the opening in the side wall.

2. A cushioning conversion system as set forth in claim 1, wherein the conversion assembly of the cushioning conversion machine includes a forming assembly which forms the stock material into a strip, a feeding assembly which feeds the stock material through the forming assembly, and a cutting assembly which cuts the strip into sections.

3. A cushioning conversion system as set forth in claim 2, wherein the forming assembly causes inward turning of the lateral edges of the stock material.

4. A cushioning conversion system as set forth in either claim 3, wherein the feeding assembly pulls the stock material through the forming assembly and also connects a central band of the strip.

5. A cushioning conversion system as set forth in claim 1, wherein the receptacle includes a set of walls forming a rectangular structure.

6. A cushioning conversion system as set forth in claim 1, wherein the pads are directly deposited into the receptacle by the cushioning conversion machine.

7. A cushioning conversion system as set forth in claim 1, wherein the packaging surface is located adjacent the cushioning conversion machine.

8. A cushioning conversion system as set forth in claim 7, wherein the receptacle is located directly above the packaging surface.

9. A cushioning conversion system as set forth in claim 1, wherein the receptacle includes a set of walls forming a rectangular structure, and the set of walls includes a bottom wall and wherein the bottom wall includes a slide which slopes towards the opening.

10. A cushioning conversion system as set forth in claim 1, wherein the receptacle includes a set of walls forming a rectangular structure, and the set of walls includes two side walls and at least one of the side walls includes the opening.

11. A cushioning conversion system as set forth in claim 10, wherein each of the side walls includes a pad-withdrawal opening whereby the cushioning pads may be withdrawn from either side of the receptacle.

12. A cushioning conversion system as set forth in claim 1, wherein the pads are placed in the vertical stack in a semi-random fashion in the receptacle.

13. A cushioning conversion system as set forth in claim 1, wherein the pads are dropped into the receptacle from the cushioning conversion machine.

14. A cushioning conversion system as set forth in claim 1, wherein the dispenser includes a support on which the receptacle is mounted.

15. A cushioning conversion system as set forth in claim 1, wherein the receptacle includes a set of walls forming a rectangular structure, and the set of walls includes a top wall.

16. A cushioning conversion system as set forth in claim 1, wherein the receptacle includes a set of walls forming a rectangular structure, and the set of walls includes an upstream wall, a downstream wall, side walls, a top wall and a bottom wall, and wherein a pad-withdrawal opening is located on the downstream wall.

17. A cushioning conversion system as set forth in claim 1, wherein the dispenser includes a sensor which senses when the receptacle is full and wherein the cushioning conversion machine repeatedly produces pads until the sensor senses that the dispenser is full.

18. A cushioning conversion system as set forth in claim 1, wherein the cushioning conversion machine includes a pad-transferring assembly and wherein the pads are transferred into the receptacle by the pad-transferring assembly.

19. A cushioning conversion system as set forth in claim 1, wherein the receptacle is mounted to the cushioning conversion machine.

20. A cushioning conversion system as set forth in claim 1, wherein the packaging surface is a conveyor having a horizontal moving surface.

21. A cushioning conversion system as set forth in claim 1, wherein the pads are placed in the vertical stack in row fashion in the receptacle.

22. A cushioning conversion system as set forth in claim 1, wherein the packaging surface is a table having a horizontal work platform.

23. A cushioning conversion system as set forth in claim 22, wherein the pads are placed in the vertical stack in row fashion in the receptacle.

24. A cushioning conversion system as set forth in claim 1, wherein the receptacle includes a set of walls forming a rectangular structure, and the set of walls includes only one side wall whereby one side of the receptacle is open for withdrawal of pads therefrom.

25. A cushioning conversion system as set forth in claims 1, wherein the pads are vertically stacked in a plurality of rows within the receptacle.

26. A cushioning conversion system as set forth in claim 25, wherein the receptacle comprises a compartment for each of the plurality of rows of vertically stacked pads.

27. A cushioning conversion system as set forth in claim 1, wherein the cushioning conversion machine repeatedly produces pads until a predetermined number of pads have been placed in the receptacle.

28. A cushioning conversion system as set forth in claim 1, further comprising a loader which loads the pads produced by the cushioning conversion machine into the receptacle.

29. A cushioning conversion system as set forth in claim 28, further comprising a stage and wherein the cushioning conversion machine deposits the pad onto the stage and the loader lifts the pad from the stage and deposits it into the receptacle.

30. A cushioning conversion system as set forth in claim 29, wherein the stage includes a sensor which senses the presence of a pad on the stage and wherein the loader is activated when the sensor senses the presence of a pad.

31. A cushioning conversion system as set forth in claim 28, wherein the loader includes a sensor which senses when the loader is in a condition ready for loading.

32. A cushioning conversion system as set forth in claim 1, wherein the cushioning conversion machine is located at a loading site and the packaging surface is located at a remote packaging site and wherein the dispenser is adapted to be transported from the loading site to the packaging site for withdrawal of the pads from the receptacle for packaging purposes and transported back to the loading site for loading of pads into the receptacle.

33. A cushioning conversion system as set forth in claim 1, wherein the dispenser includes a support on which the receptacle is mounted and wherein the support includes a base having roller members thereon for rolling the dispenser between the loading site and the packaging site.

34. A cushioning conversion system as set forth in claim 1, wherein the dispenser includes a support on which the receptacle is mounted in such a manner that the receptacle is vertically adjustable to a plurality of heights.

35. A cushioning conversion system as set forth in claim 34, wherein the receptacle is mounted in spring-loaded fashion to the support.

36. A system as set forth in claim 1, wherein the receptacle includes a pair of walls closely spaced to accommodate the width of a pad for stacking the pads in a vertical row within the receptacle.

37. A system as set forth in claim 1, wherein the conversion assembly converts the sheet-like stock material into cushioning pads having a width dimension and a thickness dimension which is less than the width dimension, the dispenser positioned to receive the pads in a vertical stack such that the accumulated thickness dimensions of the stacked pads is approximately equal to the vertical height of the stack.

38. A cushioning conversion system comprising a cushioning conversion machine, a packaging surface, and a dispenser;

the cushioning conversion machine including a conversion assembly which converts a sheet-like stock material into cushioning pads;

the dispenser including a receptacle in which the pads are placed in a vertical stack as they are produced by the cushioning conversion machine; and the receptacle being positioned above the packaging surface, the receptacle including a set of walls forming a rectangular structure, and at least one of the walls including an opening for selectively withdrawing the cushioning pads from the dispenser;

wherein the opening is sized so that the pads are withdrawn one-by-one from the dispenser.

39. A cushioning conversion system as set forth in claim 38, wherein the opening is positioned so that only the bottom-most pad may be withdrawn from the dispenser.

40. A method of using a cushioning conversion system having a cushioning conversion machine, a packaging surface and a dispenser, comprising:

converting a sheet-like stock material into cushioning pads;

stacking the pads in a vertical stack in a receptacle in the dispenser as the pads are produced, the receptacle having a side wall with an opening therein; and selectively withdrawing pads from the opening in the side wall of the receptacle.

* * * * *